United States Patent [19]

Petroff

[11] Patent Number: 4,669,337

[45] Date of Patent: Jun. 2, 1987

[54] KNIFE SHARPENER

[75] Inventor: Cvetan Petroff, Northcote, Australia

[73] Assignee: McPherson's Limited, Australia

[21] Appl. No.: 873,177

[22] Filed: Jun. 11, 1986

[30] Foreign Application Priority Data

Jun. 14, 1985 [AU] Australia ..... PH1038

[51] Int. Cl.[4] ..... B24B 3/54

[52] U.S. Cl. ..... 76/86; 30/138; 51/214

[58] Field of Search ..... 76/82, 86, 88; 30/138; 51/214, 211, 205 WG

[56] References Cited

U.S. PATENT DOCUMENTS

| | | | |
|---|---|---|---|
| 3,676,961 | 7/1972 | Jackson | 30/138 |
| 3,774,350 | 11/1973 | Bayly | 30/138 |
| 3,861,246 | 1/1975 | Walker . | |
| 4,041,651 | 8/1977 | Bayly | 76/82 |
| 4,091,691 | 5/1978 | Bayly | 76/86 |
| 4,494,339 | 1/1985 | Pittaway . | |
| 4,604,836 | 8/1986 | Huang | 30/138 |

OTHER PUBLICATIONS

European Patent Application No. 0110661 to Wiltshire.

*Primary Examiner*—Roscoe V. Parker

*Attorney, Agent, or Firm*—Lerner, David, Littenberg Krumholz & Mentlik

[57] ABSTRACT

A blade sharpener having an access opening through which a blade is moved to be sharpened and including a sharpening device which engages with and sharpens the blade cutting edge and a reaction member which engages with and applies downward pressure to the blade back edge. The reaction member has an upper portion which is pivotally mounted adjacent an upper extremity of the access opening and at a location forward of the sharpening device. A lower portion of the reaction member is engageable with a knife blade. The sharpening device is mounted adjacent the lower extremity of the access opening. A spring urges the reaction member into a rest position at which the lower portion of that member is located forward of the sharpening device and rearward of the pivotal mounting of the reaction member. The arrangement is such that a blade being moved into the sharpener engages the reaction member before engaging the sharpening device and pushes that member away from the rest position so that its lower portion moves over and rearwardly beyond the sharpening device. The sharpener is adapted for removable location within the open mouth of a blade protecting scabbard.

20 Claims, 13 Drawing Figures

KNIFE SHARPENER

BACKGROUND OF THE INVENTION

This invention relates to knife sharpeners of the kind which sharpen a knife blade as a result of the cutting edge of that blade being moved over the sharpener. It will be convenient to hereinafter describe the invention in relation to such sharpeners as used in combination with a scabbard or other protective cover for the blade.

U.S. Pat. Nos. 3,676,961 (Jackson), 3,774,350 (Bayly), 4,041,651 (Bayly) and 4,091,691 (Bayly) relate to scabbard-sharpener conbinations as referred to above. Those prior constructions have been satisfactory for sharpening standard blades, but they are not entirely suitable for use with special blades having a narrow tip. Narrow tip blades are used for delicate cutting operations such as filleting fish, and it is important that the cutting edge of such blades be kept in good condition right up to the very tip of the blade. Prior blade sharpener combinations as referred to above are unable to satisfy that requirement.

The Jackson blade sharpener includes means for maintaining downward pressure on a knife blade during its passage across the actual sharpening device. That pressure applying means is so arranged, however, that it does not engage the knife blade until that blade is moved inwardly some distance beyond the sharpening device and loses contact with the blade during withdrawal before the blade has left contact with the sharpening device. It follows that the cutting edge at the tip portion of the blade is not subjected to the same sharpening control as are other parts of the blade and is therefore not sharpened properly.

The Bayly blade sharpeners are arranged so that pressure applying means of one form or another engages and bears down on the back edge of a blade close to the time at which the blade cutting edge first contacts the sharpening device. In spite of that early contact, the sharpeners have a configuration such that they are unable to effectively sharpen the tip portion of a narrow blade. Each of those sharpeners is arranged to operate with knife blades of substantial depth, even close to the tip, and the maximum downward force on the blade is achieved while the deeper sections of the blade are moving over the sharpening device. Minumum downward force and consequently minimum sharpening effect is achieved while the tip portion of the blade is moving over the sharpening device.

It is an object of the present invention to provide a blade sharpener which is able to effectively sharpen a blade up to the very tip thereof. It is a further object of the invention to provide a blade sharpener which is particularly suited for use with blades which are relatively narrow or have a shallow depth.

SUMMARY OF THE INVENTION

In accordance with one aspect of the invention, there is provided a blade sharpener including, a mounting structure having an access opening through which a blade can be moved, a sharpening device connected to said structure adjacent a lower extremity of said opening so as to be engaged by the cutting edge of a blade located within said opening, and a reaction member having an upper portion pivotally connected to said structure adjacent an upper extremity of said opening and a lower portion arranged to engage a back edge of a blade located in said opening so as to press the cutting edge of the blade against said sharpening device, said reaction member being resiliently urged about said pivotal connection in a forward direction towards a rest position at which it substantially closes said opening and at which said lower portion is located forwardly of said sharpening device and rearwardly of the axis of said pivotal connection, the arrangement being such that said reaction member is caused to swing rearwardly about said pivotal connection in response to engagememt by a blade moved rearwardly through said opening, whereby said lower portion is moved away from said rest position to pass over and rearwardly of said sharpening device.

According to another aspect of the invention, there is provided a blade sharpener including, a mounting structure having an access opening through which a blade can be moved, a sharpening device connected to said structure adjacent a lower extremity of said opening so as to be engaged by the cutting edge of a blade located within said opening, a reaction member having an upper portion pivotally connected to said structure adjacent an upper extremity of said opening and a lower portion arranged to engage a back edge of a blade located in said opening so as to press the cutting edge of the blade against said sharpening device, biasing means resiliently urging said reaction member to move about said pivotal connection in a forward direction towards a rest position at which said reaction member substantially closes said opening and at which said lower portion is located forwardly of said sharpening device and rearwardly of said pivotal connection, said lower portion being arranged to be engaged by a blade being moved rearwardly through said opening prior to that blade engaging said sharpening device, a hollow scabbard adapted to receive and protect a blade extending through said opening, and means releasably connecting said mounting structure to an end of said scabbard, the arrangement being such that said reaction member is caused to swing rearwardly about said pivotal connection in response to engagement by a blade being moved rearwardly through said opening, whereby said lower portion is moved away from said rest position to pass over and rearwardly of said sharpening device.

An embodiment of the invention is described in detail in the following passages of the specification which refer to the accompanying drawings. The drawings, however, are merely illustrative of how the invention might be put into effect, so that the specific form and arrangement of the various features as shown is not to be understood as limiting on the invention.

DESCRIPTION OF PREFERRED EMBODIMEMT

Figure 3:
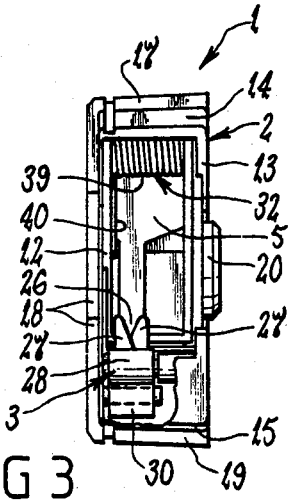
FIG. 3 is a rear elevational view of the sharpener shown in FIG. 1.
Figure 6:
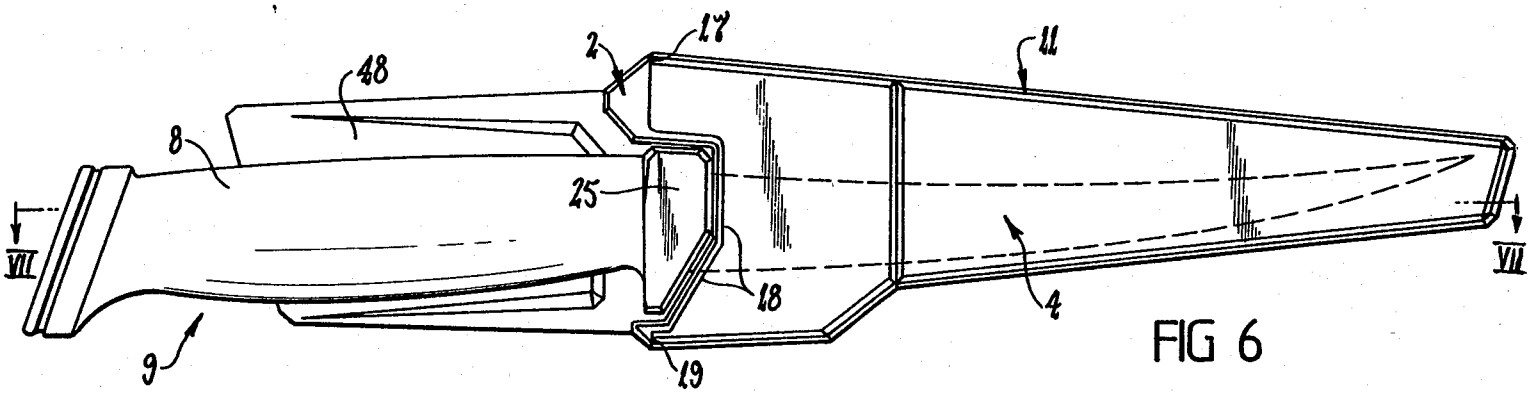
FIG. 6 is an elevation view of a scabbard incorporating a sharpener as shown in FIGS. 1 to 5 and having a knife inserted therein.

The knife blade sharpener 1 shown in the drawings includes a mounting structure 2 and a sharpening device 3 carried by the structure 2 and arranged for sharpening a knife blade 4 (FIG. 6). The structure 2 has an access opening 5 (FIG. 3) for receiving the knife blade 4. As best seen in FIGS. 6 and 9 to 12, the knife blade 4 as shown is of the kind having a relatively shallow depth and the cutting edge 6 extends from an extreme tip 7 rearwardly towards a handle 8 of the knife 9. A back edge 10 of the blade 4 and the cutting edge 6 converge towards the tip 7 over a substantial part of the length of the blade 4 so that the blade 4 has a narrow or fine tip portion. The knife 9 as shown is of a kind suitable for use as a fish filleting knife and the blade 4 may be relatively flexible. It will be convenient to generally describe the invention with reference to the fish filleting knife 9 as shown although the invention is not limited to use with that type of knife.

As shown in FIGS. 1 to 5, the mounting structure 2 is a sleeve-like member having a passage therethrough which forms the access opening 5. The mounting structure 2 as shown is adapted for connection to a blade scabbard 11 as hereinafter described in detail. In an alternative construction, which is not shown, the structure 2 could be an integral part of the scabbard 11. According to yet another alternative, the structure 2 could be arranged to exist separate from a blade scabbard.

Figure 7:
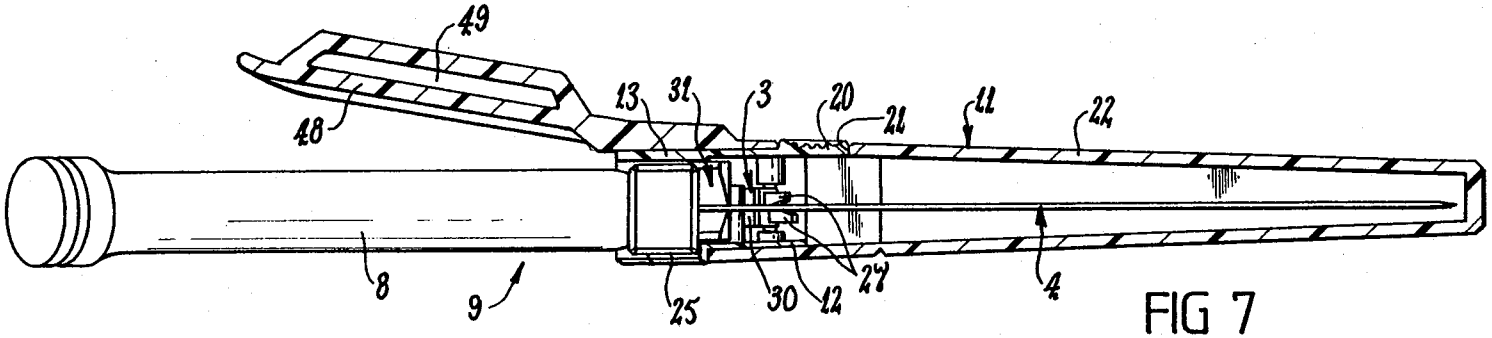
FIG. 7 is a cross-sectional view taken along line VII—VII of FIG. 6.

The structure 2 as shown is of substantially rectangular form in transverse cross-section and has two side walls 12 and 13 and upper and lower walls 14 and 15 respectively. The opening 5 is defined between those walls and therefore also has a substantially reactangular shape. In the construction shown, the structure 2 is arranged to be a neat sliding fit within an open end 16 (FIG. 8) of the scabbard 11 as shown in FIGS. 6 and 7. That is, the external configuration as defined by the walls 12, 13, 14 and 15 is substantially complementary to the internal configuration of the open end 16 of the scabbard 11.

Figure 8:
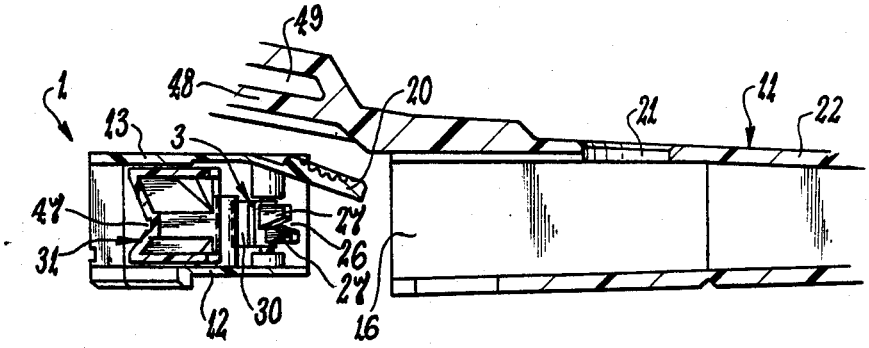
FIG. 8 is a sectional view of part of the scabbard shown in FIGS. 6 and 7 and showing the sharpener removed from the scabbard.
Figure 4:
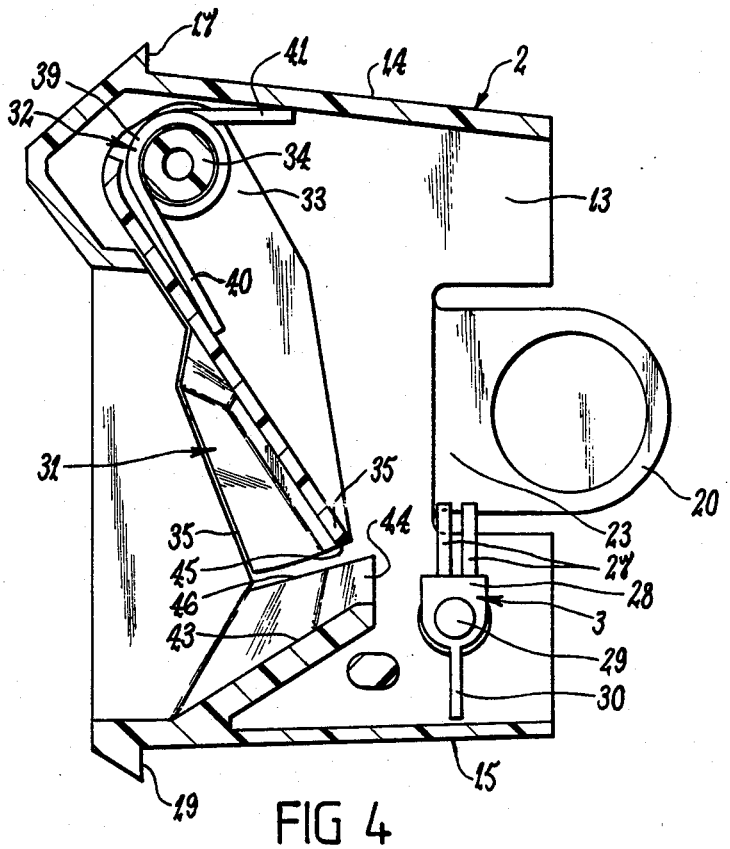
FIG. 4 is an enlarged cross-sectional view taken along line IV—IV of FIG. 2.
Figure 5:
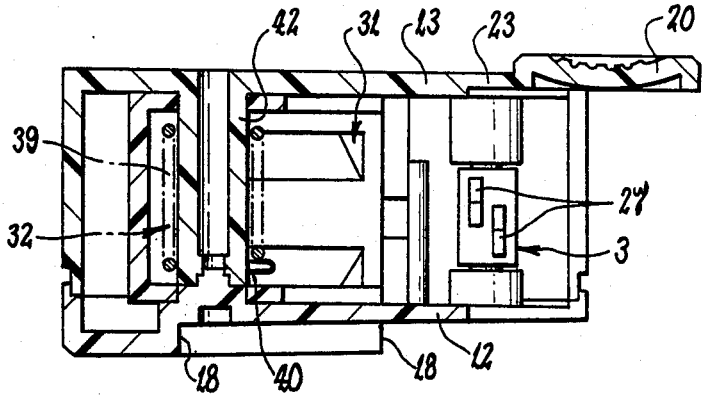
FIG. 5 is an enlarged cross-sectional view taken along line V—V of FIG. 1.

Insertion of the structure 2 into the scabbard open end 16 is limited by stop shoulders 17, 18 and 19 formed on the walls 14, 12 and 15 respectively, but other means could be adopted for that purpose. Retaining means is provided to releasably retain the structure 2 within the scabbard open end 16, and in the construction shown that retaining means includes a laterally projecting button 20 connected to the structure side wall 13 and arranged to locate within an aperture 21 (FIG. 8) formed through a side wall 22 of the scabbard 11. It is preferred, as shown, that the button 20 is attached to the structure 2 through a flexible connection such that the button 20 can be moved between an operative position (FIG. 7) and an inoperative position (FIG. 8). It is also preferred that the flexible connection includes an arm 23 which is formed integral with both the structure side wall 13 and the button 20 as best seen in FIG. 4.

The connecting arm 23 is predisposed to normally hold the button 20 in the operative position as shown in FIG. 7. Inward pressure applied to the button 20, however, causes the arm 23 to bend or flex so that the button 20 is moved clear of the aperture 21 and the structure 2 is then able to be pulled out of the scabbard 11. As shown in FIG. 8, similar inward deflection of the button 20 is necessary to condition the structure 2 for replacement within the scabbard 11.

Figure 1:
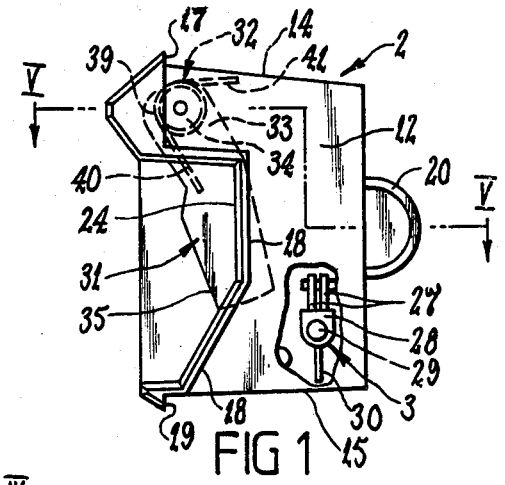
FIG. 1 is a side elevational view of a blade sharpener according to one embodiment of the present invention.
Figure 2:
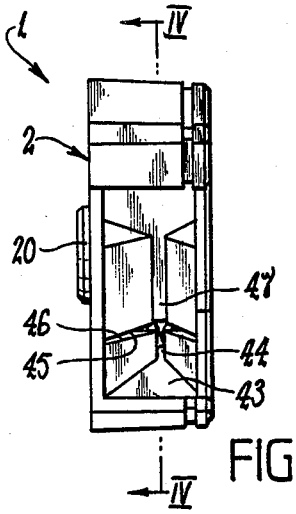
FIG. 2 is a front elevational view of the sharpener shown in FIG. 1.

A recess 24 may be formed in the front edge of the structure side wall 12 as shown in FIG. 1. That recess 24 can have a shape substantially complementary to the front end shape of the knife handle 8 as shown in FIG. 6 so as to at least partly enclose a front end portion 25 of the handle 8. The knife 9 is thereby located in a particular position relative to the scabbard 11, and the structure 2, when the blade 4 is fully inserted into the scabbard 11 as shown in FIG. 6.

The sharpening device 3 includes a sharpening recess 26 which is adapted to receive the cutting edge 6 of the knife blade 4. In the preferred embodiment as shown, the sharpening recess 26 is of V shape so as to have a configuration substantially complementary to that of the blade cutting edge 6. The recess 26 may be defined between a pair of overlapping circular cutters (not shown). It is preferred, however, that the sharpening recess 26 is defined between a pair of sharpening elements 27 of non-circular peripheral shape and which may be made of any suitable material. By way of example, the sharpening elements 27 may be made of tungsten carbide material.

In the preferred construction shown, the sharpening device 3 is mounted on the structure 2 so as to be capable of limited backward and forward rocking movement as the knife blade 4 is respectively inserted into and withdrawn from the scabbard 11. For that purpose the sharpening elements 27 may be mounted on a base member 28 as shown which is pivotally connected to the mounting structure 2 through two stub axles 29, each of which is rotatably mounted in a respective wall 12 and 13 of the structure 2. The facility for rocking movement is desirable so that the cutting edge 6 of the knife blade 4 can be moved through the V-shaped sharpening recess 26 with minimum likelihood of the blade 6 skipping or jamming within the recess 26.

Figure 9:
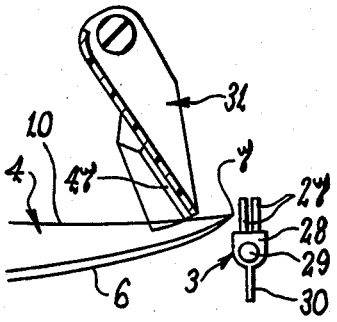
FIG. 9 is semi-diagrammatic view showing the tip of a knife blade as it is first inserted into a sharpener according to FIGS. 1 to 5.
Figure 11:
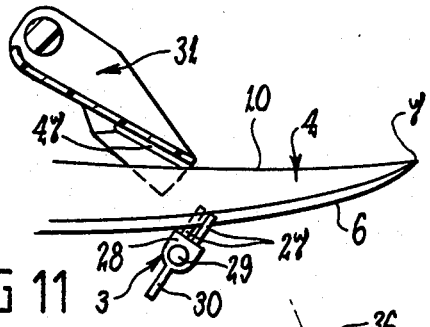
FIG. 11 is a view similar to FIG. 10 but showing the knife blade even further advanced into the sharpener.
Figure 12:
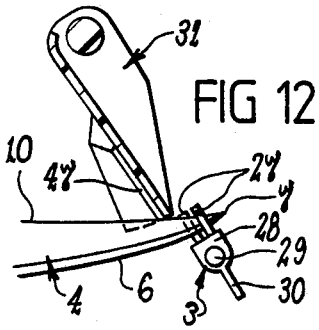
FIG. 12 is a view similar to FIG. 10 but showing the knife blade being withdrawn fron the sharpener.

The sharpening device 3 can rock between forward and backward positions as shown in FIGS. 9 and 11 respectively according to whether the knife blade 4 is being withdrawn from or moved into the scabbard 11. The degree of maximum tilt of the device 3 may be about 25° in the backward direction and about 30° in the forward direction, but it will be appreciated that those angles are merely preferred rather than essential. A blade 30 may be arranged to engage stop surfaces so as to limit the pivotal or rocking movement of the sharpening device 3.

The knife sharpener 1 of the present invention is further provided with a reaction member 31 which is arranged to engage the back edge 10 of a knife blade 4 inserted through the access opening 5 and thereby urge the blade cutting edge 6 against the sharpening device 3. It is preferred that the member 31 is resiliently urged towards a rest position as shown in FIG. 4, and is arranged to initially engage the knife blade 4 at a location forward of the sharpening device 3 so as to thereby cause the sharpening action to extend to the extreme tip 7 of the knife blade 4. That is, when a knife blade 4 is being moved into the scabbard 11, it engages the member 31 before engaging the sharpening device 3. Similarly when the knife blade 4 is being withdrawn from the scabbard 11, the member 31 remains in engagement to press the cutting edge 6 into the sharpening recess 26 for the full length of the cutting edge 6 until the extreme tip 7 of the knife blade 4 disengages from the sharpening device 3.

In the preferred construction shown, biasing means 32 (FIGS. 1 and 5) acts on the member 31 so as to urge it against the back edge 10 of the knife blade 4. The reaction member 31 preferably comprises a lever which has an upper portion 33 pivotally connected at 34 to the mounting structure 2. The axis of the pivotal connection 34 is transverse to the direction of movement of the blade 4. The lever 31 also has a lower portion 35 which is arranged to contact the back edge 10 of the knife blade 4 to apply force thereto so as to urge the knife blade 4 into the sharpening recess 26. The pivotal connection 34 of the lever 31 is located forwardly of the sharpening device 3. When the lever 31 is in the rest position as shown in FIG. 4, the lower portion 35 is located rearwardly of the pivotal connection 34 and forwardly of the sharpening device 3. The arrangement is such that the lever 31 slopes in the rearward direction away from the pivotal connection 34 and generally towards the sharpening device 3.

Figure 13:
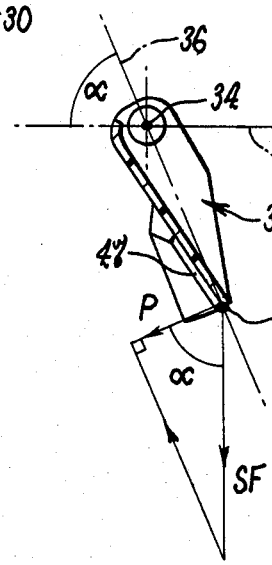
FIG. 13 is a force diagram relating to the action of the sharpener on a knife blade.

An arrangement as described above is such that the sharpening force applied between the sharpening device 3 and the cutting edge 6 of the knife 9 is greater when the tip region of the blade 4 is being sharpened than when the part of the blade 4 nearer the handle 8 is being sharpened. That is, the sharpening force progressively increases as the point of engagement between the sharpening device 3 and the cutting edge 6 approaches the knife tip 7. The foregoing will be apparent from the FIG. 13 force diagram in which P is the force applied by the lever 31, $\alpha$ is the angle between a line 36 which represents the angle of slope of the lever 31 and another line 37 which represents the general direction of movement of a blade 4 being moved across the sharpening device 3, and SF is the sharpening force. The line 36 extends from the lever pivot 34 to the point of contact 38 with a knife blade 4. The value of SF is given by the formula:

$$SF = P/\cos\alpha$$

The foregoing is an approximation since the actual sharpening force is affected by variations in the value of the force P as the lever 31 moves through its range of positions. The actual sharpening force also depends on frictional forces at the lever pivot 34, and frictional forces between the contact end of the lever 31 and the back edge 10 of the blade 4.

Figure 10:
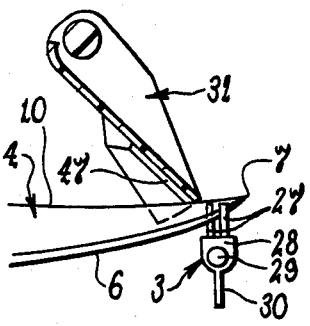
FIG. 10 is a view similar to FIG. 9 but showing the knife blade moved further into the sharpener.

When the knife blade 4 is inserted into the blade sharpener 1, the lower portion 35 of the lever 31 is caused to move towards a position generally opposite to the sharpening device 31 as shown by FIGS. 9 and 10. It follows that at one stage of insertion of the knife blade 4 into the blade sharpener 1, the lever 31 is applying a force to the back edge 10 of the knife blade 4 at a point directly opposite to the sharpening device 3. As the blade 4 continues to be moved through the sharpener 1, the lower portion 35 moves over and rearwardly beyond the sharpening device 3 so that it moves from a positon forward of the sharpening device 3 to a position rearward thereof. The point of application of force to the back edge 10 of the knife blade 4 is therefore moved from one side to the other of the sharpening device 3 and back again as the knife blade 4 is inserted into and withdrawn from the blade sharpener 1. That enables the point of application of force to be kept relatively near to the sharpening device 3 under all conditions of use of the sharpener 1 and that ensures maintenance of sharpening contact between the blade 4 and the device 3. Also the foregoing configurations and manner of operation enables the maximum sharpening force to be applied at the blade tip 7 rather than being expended before the tip 7 reaches the sharpening device 3.

The biasing means 32 for urging the lever 31 into contact with the blade back edge 10 may be of any convenient form and configuration. In the example shown, the biasing means 32 comprises a coil spring 39 having laterally extending arms 40 and 41 (FIG. 1) at respective opposite ends thereof. The spring 39 is located around a pin 42 (FIG. 5) which forms part of the pivotal mounting 34 of the lever 31, and the arms 40 and 41 engage the lever 31 and the structure upper wall 14 respectively. The spring 31 is preloaded so that the arms 40 and 41 act as torsion arms urging the lever 31 into the rest position as shown in FIG. 1. By way of example, such preloading may involve 300° movement of the arms 40 and 41 relative to one another from the position at which spring 39 is relaxed.

The optimum configuration and various dimensions of the components of the sharpener 1 may be different for different knife blades. In the example of a filleting knife or other knife having a blade depth increasing from 0 to about 23 mm, the lever 31 may be about 33 mm long (pivot 34 to contact point 38) and have its pivot 34 located about 23 mm forward of the sharpening device 3, and the angle $\alpha$ (FIG. 13) without a knife in the sharpener 1 may be about 67°.

In the construction shown, the sharpener 1 is provided with a ramp 43 which slopes upwardly and rearwardly towards the sharpening recess 26 (FIG. 4). A guide 44 may be provided at the upper end of the ramp 43 so as to slidably receive and guide the cutting edge 6 of a blade 4 being moved into the recess 26. When the lever 31 is in the rest position, a lower terminal end surface 45 of the lever 31 is preferably located close to an opposed surface 46 of the structure 2 which is coincident with the upper end of the ramp 43. As a result, the lever 31 substantially closes the access opening 5 when in the rest position. At least, the lever 31 closes the opening 5 to such an extent that a blade 4 cannot be moved through the opening 5 to engage the sharpening device 3 without first engaging the lower end portion 35 of the lever 31. A guide groove 47 is preferably formed in the front side of the lever 31 so as to slidably receive and guide the back edge 10 of a blade 4 being moved through the opening 5. The groove 47 and slot 44 thereby combine to ensure that the blade 4 is restrained against lateral tilting during a sharpening operation.

When a blade 4 is introduced into the opening 5, the tip 7 engages the lever 31 at or near the terminal end surface 45 and the lever 31 is caused to swing rearwardly and upwardly to bear against the back edge 10 of the blade 4 as that blade 4 is moved further through the opening 5. As the knife tip 7 engages with the sharpening device 3, that device 3 swings rearwardly about its pivot and thereby prevents jamming of the blade 4 within the sharpening recess 26.

The force applied to the back edge 10 of the knife blade 4 by the lever 31 ensures that the extreme tip 7 of the blade 4 is pushed into the base of the sharpening recess 26 and consequently the sharpening action will commence at the extreme tip 7. That is, the sharpening elements 27 engage with and move along respective opposite sides of the cutting edge 6 up to the tip 7 of the blade 4. As the blade 4 is moved further into the sharpener 1, it presents a greater depth between the lever 31 and the device 3, and the lever 31 swings about its pivot 34 to compensate for that increase (see FIG. 11). The lever 32, however, remains in contact with the blade back edge 10 and continues to apply force thereto to maintain the cutting edge 6 in contact with the sharpening device 3.

When the knife blade 4 is being withdrawn from the sharpener 1 (FIG. 12), the sharpening device 3 swings forward on its pivot mounting so that the cutting edge 6 runs through the sharpening recess 26 at an acute angle. The lower portion 35 of the lever 31 continues to apply force to the back edge 10 of the knife blade 4 throughtout the withdrawal movement and particularly until extreme tip 7 of the knife blade 4 separates from the sharpening elements 27.

The inclination of the lever 31 is such that the frictional resistance to withdrawal of the knife blade 4 will be greater than the frictional resistance to insertion of the blade 4. That arises because the frictional force at the back edge 10 acts in the forward direction when the knife blade 4 is being inserted and, because of the rearward inclination of the lever 31, thereby reduces the resulting component of force acting upwardly along the line of the lever 31. Another component of the frictional force acts vertically upwardly and thereby reduces the reactive sharpening force on the knife blade 4. Conversely, when the knife blade 4 is being withdrawn, the frictional force acts rearwardly and can be analysed into components comprising a downward force which augments the sharpening force and a force which acts upwardly along the general line of the lever 31. The foregoing provides something of a safety feature because it is easier to insert a blade 4 into the sharpener 1 than to withdraw a blade 4 from the sharpener 1.

It will be apparent from the foregoing that a sharpener 1 according to the present invention enables a knife blade 4 to be sharpened effectively right up to the extreme tip 7 of that blade 4.

The scabbard 11 of the preferred embodiment shown, provides both a protective sheath for a blade 4 and also a mounting for the structure 2. The scabbard 11 as shown has a guide plate 48 which extends angularly outwards away from the structure 2 so that the user can readily insert a knife blade 4 into the access opening 5 (FIG. 7). The guide plate 48 is preferrably provided with a fastening passage 49 at the back surface thereof to enable the scabbard 11 to be attached to a belt, for example. In an alternative arrangement not shown, a resilient jaw may be substituted for the passage 49 to enable the scabbard 11 to be hooked onto a support. The guide plate 48 is at a small angle to the general direction of the scabbard 11 so as to keep the knife handle 8 displaced outwardly from the guide plate 48 as shown in FIG. 7 and thereby enable the user to readily grip the handle 8.

Various alterations, modifications and/or additions may be made to the construction and arrangement of parts as herein described without departing from the spirit and scope of the present invention.

Having now described my invention, what I claim as new and desire to secure by Letters Patent is:

1. A blade sharpener including, a mounting structure having an access opening through which a blade can be moved, a sharpening device connected to said structure adjacent a lower extremity of said opening so as to be engaged by the cutting edge of a blade located within said opening, and a reaction member having an upper portion pivotally connected to said structure adjacent an upper extremity of said opening and a lower portion arranged to engage a back edge of a blade located in said opening so as to press the cutting edge of the blade against said sharpening device, said reaction member being resiliently urged about said pivotal connection in a forward direction towards a rest position at which it substantially closes said opening and at which said lower portion is located forwardly of said sharpening device and rearwardly of the axis of said pivotal connection, the arrangement being such that said reaction member is caused to swing rearwardly about said pivotal connection in response to engagement by a blade being moved rearwardly through said opening, whereby said lower portion is moved away from said rest position to pass over and rearwardly of said sharpening device.

2. A blade sharpener according to claim 1, wherein said lower portion is arranged to be engaged by a blade being moved rearwardly through said opening prior to that blade engaging said sharpening device.

3. A blade sharpener according to claim 1, wherein said sharpening device includes a sharpening recess which receives the cutting edge of a blade to be sharpened by said device, and said structure includes a ramp which slopes downwardly and forwardly from said sharpening recess.

4. A blade sharpener according to claim 3, wherein a guide slot for slidably receiving a blade cutting edge is located at an upper end portion of said ramp.

5. A blade sharpener according to claim 1, wherein a guide groove for slidably receiving the back edge portion of a blade is formed in a front side of said reaction member and extends in a direction from said lower portion towards said upper portion.

6. A blade sharpener according to claim 1, wherein a lower end surface of said reaction member is located close to an opposed surface of said structure when said reaction member is in said rest position.

7. A blade sharpener according to claim 6, wherein a guide groove for slidably receiving the back edge portion of a blade is formed in a front side of said reaction member and extends in a direction from said lower end surface towards said upper portion, and a guide slot for slidably receiving a blade cutting edge is provided in said opposed surface and extends in the direction of movement of a blade through said opening.

8. A blade sharpener according to claim 1, wherein said reaction member is resiliently urged about said pivotal connection by biasing means.

9. A blade sharpener according to claim 1, wherein said sharpening device includes a base member and a pair of sharpening elements attached to said base member and arranged to define between them a sharpening recess which is adapted to receive the cutting edge of a blade to be sharpened, and said base member is pivotally mounted on said structure for limited rocking movement in the direction of movement of a blade passing through said opening.

10. A blade sharpener according to claim 1, wherein said mounting structure is a sleeve-like member having a passage therethrough which forms said access opening, and said mounting structure is connected to an end of a hollow scabbard arranged to receive and protect a blade which extends through and rearwardly beyond said access opening.

11. A blade sharpener according to claim 10, wherein a guide plate extends from said scabbard end and is located at one side of said scabbard to guide a blade into said access opening.

12. A blade sharpener according to claim 11, wherein said guide plate extends angularly relative to the longitudinal axis of a blade located within said scabbard.

13. A blade sharpener according to claim 1, wherein said mounting structure forms part of a hollow scabbard which encloses and protects a blade passed through said opening.

14. A blade sharpener according to claim 13, wherein said scabbard includes a body containing a blade receiving cavity, and said mounting structure is removably connected to said body so that a blade passing through said access opening is receivable in said cavity.

15. A blade sharpener including, a mounting structure having an access opening through which a blade can be moved, a sharpening device connected to said structure adjacent a lower extremity of said opening so as to be engaged by the cutting edge of a blade located within said opening, a reaction member having an upper portion pivotally connected to said structure adjacent an upper extremity of said opening and a lower portion arranged to engage a back edge of a blade located in said opening so as to press the cutting edge of the blade against said sharpening device, biasing means resiliently urging said reaction member to move about said pivotal connection in a forward direction towards a rest position at which said reaction member substantially closes said opening and at which said lower portion is located forwardly of said sharpening device and rearwardly of said pivotal connection, said lower portion being arranged to be engaged by a blade being moved rearwardly through said opening prior to that blade engaging said sharpening device, a hollow scabbard adapted to receive and protect a blade extending through said opening, and means releasably connecting said mounting structure to an end of said scabbard, the arrangement being such that said reaction member is caused to swing rearwardly about said pivotal connection in response to engagement by a blade being moved rearwardly through said opening, whereby said lower portion is moved away from said rest position to pass over and rearwardly of said sharpening device.

16. A blade sharpener according to claim 15, wherein said biasing means includes a coil spring located at said pivotal connection and having two arms which engage said structure and said reaction member respectively.

17. A blade sharpener according to claim 15, wherein said reaction member is in the form of a lever having said upper and lower portions at respective opposite ends thereof, and when said lever is at said rest position the longitudinal axis thereof extends at an angle within a range of 60 to 70 degrees relative to the general direction of movement of a blade passing through said opening.

18. A blade sharpener according to claim 15, wherein said connection between the mounting structure and the scabbard includes retaining means which is movable between operative and inoperative positions, and said mounting structure is separable from said scabbard when the retaining means is in its inoperative position.

19. A blade sharpener according to claim 18, wherein at least part of said mounting structure is slidably located within an end portion of said scabbard so as to be surrounded by side walls of said scabbard, an aperture is formed through one said side wall, and said retaining means includes a laterally projecting button which locates within said aperture when said retaining means is in said operative position, and a flexible connection between said button and said mounting structure which permits said movement between the operative and inoperative positions and which resiliently urges said button into said operative position.

20. A blade sharpener according to claim 19, wherein said flexible connection comprises an arm which is formed integral with said mounting structure.

* * * * *